United States Patent [19]

Ball

[11] Patent Number: 4,703,963

[45] Date of Patent: Nov. 3, 1987

[54] FLUSH MOUNTED DOOR HANDLE FOR AUTOMOBILE

[75] Inventor: Stephen D. Ball, San Diego, Calif.

[73] Assignee: Nissan Design International, Inc., San Diego, Calif.

[21] Appl. No.: 830,205

[22] Filed: Feb. 18, 1986

[51] Int. Cl.[4] ..... E05C 3/26

[52] U.S. Cl. ..... 292/336.3; 292/DIG. 63

[58] Field of Search ..... 292/336.3, 347, 227, 292/221, 73, 188, DIG. 63, DIG. 47

[56] References Cited

U.S. PATENT DOCUMENTS

| | | | |
|---|---|---|---|
| 299,402 | 5/1884 | Keppel | 292/173 |
| 2,258,831 | 10/1941 | Watts | 292/227 |
| 2,661,976 | 12/1953 | Orr | 292/336.3 |
| 3,020,075 | 2/1962 | Johnstone et al. | 292/336.3 |
| 3,729,220 | 4/1973 | Andres | 292/336.3 |
| 3,848,909 | 11/1974 | Foley | 292/216 |
| 4,315,649 | 2/1982 | Lutz | 292/201 |
| 4,475,415 | 10/1984 | Yamamoto | 74/543 |
| 4,478,445 | 10/1984 | Shimizu | 292/336.3 |
| 4,588,219 | 5/1986 | Kobayashi et al. | 292/336.3 |
| 4,606,567 | 8/1986 | Kato et al. | 292/336.3 |

FOREIGN PATENT DOCUMENTS

| | | |
|---|---|---|
| 522380 | 6/1940 | United Kingdom . |
| 632123 | 11/1949 | United Kingdom . |

*Primary Examiner*—Richard E. Moore

*Attorney, Agent, or Firm*—Baker, Maxham Jester

[57] ABSTRACT

A door handle assembly is mounted at the belt line of an automobile door and includes a box-like recess formed in the door with a slide member mounted in the recess for vertical reciprocal movement. A handle member is pivotally attached to the upper edge of the slide member and conforms to the contour of the exterior panel of the door. A linkage connects the slide member to a door latch mechanism.

10 Claims, 7 Drawing Figures

FLUSH MOUNTED DOOR HANDLE FOR AUTOMOBILE

BACKGROUND OF THE INVENTION

The present invention relates to automobiles and pertains particularly to an improved door handle assembly for an automobile.

The trend in automobile design is toward windows that are flush with the sheet metal body so that the vehicle has clean, unobstructed body surfaces. The typical door body tapers to a rather narrow thickness at the belt line in order to provide a near flush mount of the window at the bottom of the window opening. The belt line is a line made by the junction of the window with the lower door panel.

This trend in design is hampered somewhat by present design of door handles and operating mechanisms. In one conventional arrangement, the door handle is mounted in the door so that it can pivot to thereby release the door latch mechanism. The handle must have sufficient leverage to actuate the door latch mechanism in order to release it. This requires a lever arm built into the handle which in turn requires operational space that is not available at the belt line.

Conventional door handles are typically mounted eight to ten inches below the belt line. At this location, the door has sufficient thickness to accommodate the handle, its lever mechanism in addition to the window glass and its operating mechanism.This location detracts from the clean line of the car body and forces the operator to bend over to grasp the handle.

The prior art approach to door handle construction for automobiles is exemplified by the following U.S. Patents:

U.S. Pat. No. 4,315,649, Lutz
U.S. Pat. No. 4,475,415, Yamamoto
U.S. Pat. No. 4,478,445, Shimizu
U.S. Pat. No. 3,848,909, Foley
U.S. Pat. No. 3,020,075, Johnstone et al
U.S. Pat. No. 3,729,220, Andres
U.S. Pat. No. 2,661,976, Orr
British Pat. No. 632,123
British Pat. No. 522,380

The Orr patent is of interest in that it discloses a box-like reciprocating button for actuation a door lock.

The remaining patents all show traditional pivoting door handles.

It is therefore desirable that a slim line door handle and operating mechanism be available for mounting at the belt line of the door of an auto body.

SUMMARY AND OBJECTS OF THE INVENTION

It is the primary object of the present invention to provide an improved door handle for automobile vehicles.

In accordance with a primary aspect of the present invention, a door handle assembly for an automobile comprises an open ended box-like recess formed in a door at the belt line, and a slide member mounted for vertical reciprocal movement in the recess. A handle member is pivotably mounted to the upper edge of the slide member. The handle member is shaped to conform to the contour of the exterior panel of the door. The handle member pivots slightly outward for increasing finger clearance and enhancing grasping thereof.

BRIEF DESCRIPTION OF THE DRAWINGS

The above and other objects and advantages of the present invention will become apparent from the following description when read in conjunction with the accompanying drawings wherein.

DETAILED DESCRIPTION OF A PREFERRED EMBODIMENT

Figure 1:
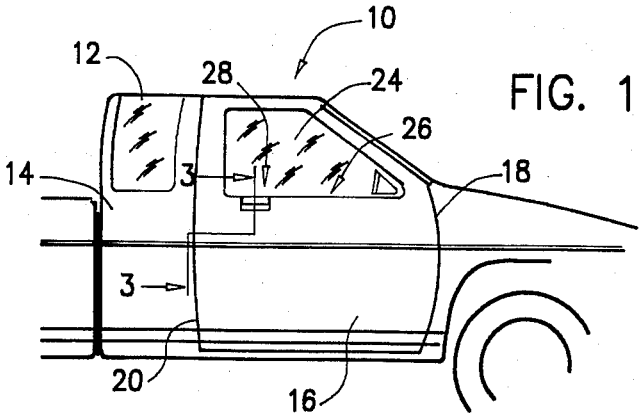
FIG. 1 is a side elevation view of a portion of the side of an automobile in the form of a pick-up truck having a handle assembly mounted in a door in accordance with the present invention.

Referring to the drawings, there is illustrated in FIG. 1 a portion of the side of a vehicle designated generally by the numeral 10 showing a door and surrounding body structure. The vehicle 10 has a roof 12 and sides 14 forming an enclosure for a driver and passenger compartment. The vehicle body is provided with side openings covered by doors (only one shown) 16 to permit access to the operator/passenger compartment.

The doors are hinged in a conventional manner (not shown) at a front vertical edge 18 to a post or vertical portion of the body at the front of the door opening. The doors swing open and closed about a vertical hinge axis at the forward edge 18. The doors are releasably attachable to a rear post at a back edge 20 of the door opening by a releasable latch mechanism. A door handle is connected to the latch mechanism and is operative to release the latch.

The upper portion of the body and the doors are provided with windows 24 to provide visibility and to allow light to enter the compartment. Many of the windows, particularly the side windows, may typically be raised or lowered. The junction 26 between the lower edge of the window 24 and the door 16 is generally referred to as the "belt line".

A door handle assembly in accordance with the invention, designated generally by the numeral 28, is mounted in the door 16 immediately adjacent to the belt line 26 of the automobile body. The door handle assembly is designed, as will be explained, to operate in minimum lateral space and to operate the door latch mechanism to release the latch.

Figure 2:
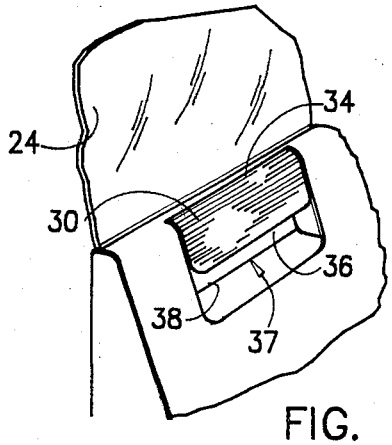
FIG. 2 is an enlarged perspective view of the handle assembly of FIG. 1.
Figure 3:
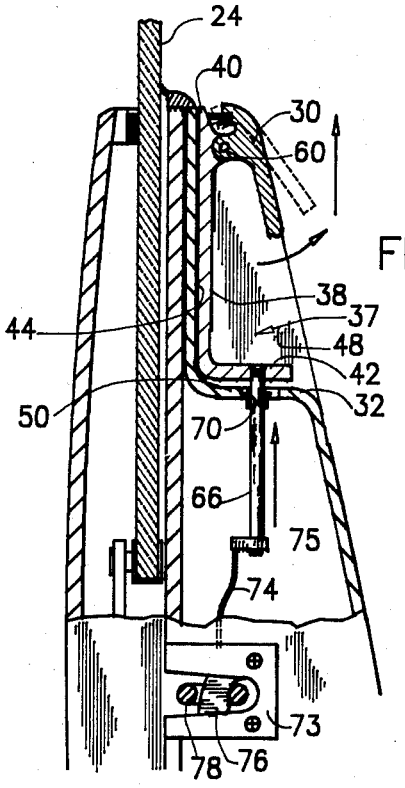
FIG. 3 is an enlarged section view taken on line 3—3 of FIG. 1.
Figure 4:
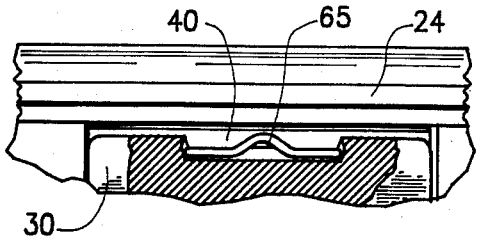
FIG. 4 is an enlarged front elevation view, partially broken away, showing details of the handle assembly of FIG. 2.

Referring to FIGS. 2 and 3, an exemplary embodiment of a handle assembly according to the invention includes a curved handle member 30. The handle member 30 fits within an outwardly and upwardly opening box-shaped recess 32 formed in the exterior panel of the door 16. The handle member is shaped to conform to the contour of the door panel surrounding the recess 32. The handle member 30 curves outward from an upper edge 34 and extends downward to a lower edge 36 for grasping. It covers an upper portion of the recess 32, leaving a slot opening 37 below the lower edge 36 which allows the fingers to be inserted into the recess for grasping the lower edge 36.

Figure 6:
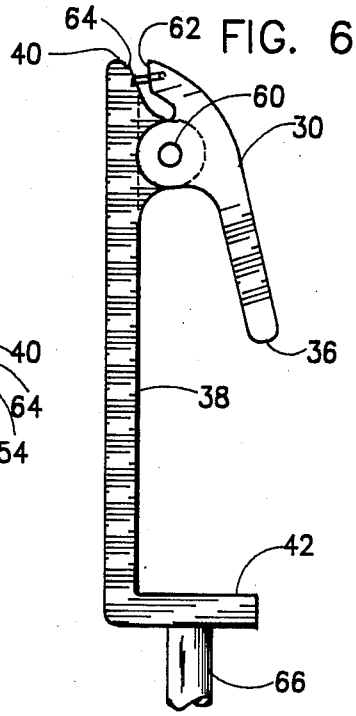
FIG. 6 is an enlarged side elevation view of the handle member and slide member of the assembly of FIG. 1.

The handle member 30 is pivotally connected along its top edge 34 to an L-shaped slide member 38 (FIGS. 3 and 6). The slide member has a vertical leg with a generally straight upper edge 40 and a horizontally extending bottom leg 42. The slide member is designed to fit within the box-like recess 32 formed in the exterior panel of the door 16. The recess opens to the top edge of the door panel at the bottom of the window opening and is of sufficient depth to accommodate the slide member 38 and the handle member 30. The recess (FIG. 2) is formed on four sides by a back wall 44, side walls 46, and 48, and bottom wall 50.

The handle member 30 has a slightly curved configuration to facilitate grasping by the hand (FIG. 6). It is normally biased to a flush position illustrated in FIG. 3 and in solid lines in FIG. 3. The handle member pivots outward from the slide member, as shown in phantom lines in FIG. 2, when grasped and pulled upward. This outward pivoting of the handle member provides space 37 between the handle member and slide member for accommodating the fingers of a hand. It also makes it more comfortable to grip the handle member and lift the same to thereby unlatch the door.

Figure 5:
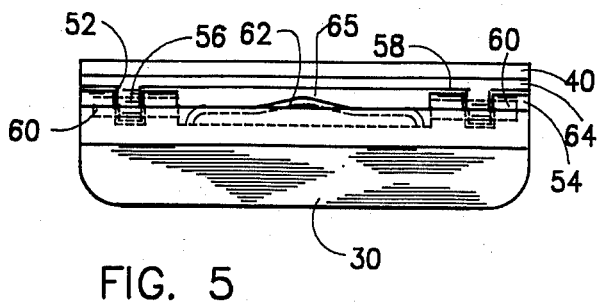
FIG. 5 is an enlarged top view of the handle member of the assembly of FIG. 1.

The handle member 30 is pivotally connected to the slide member by suitable hinge means such as shown in FIGS. 5 and 6. A suitable hinge means includes a plurality of lugs 52 and 54 on the handle member 30 which cooperate with lugs 56 and 58 on the slide member 38. Elongated hinge pins 60 extend through aligned holes or bores in the lugs. Cooperative abutting surfaces 62 and 64 (FIG. 6) on the handle and slide member control the degree of pivoting of the handle member. The handle member is preferably designed to pivot between about 15 and 25 degrees from its flush position. Specifically, the handle member pivots between the positions shown in solid and phantom lines in FIG. 3. A separate compression spring 65 is connected to the upper edge of the handle member. This spring has a V-shaped intermediate portion which is compressed between the adjacent surfaces 62 and 64 of the handle and slide members. The spring 65 biases the handle member to its normal flush position, illustrated in solid lines in FIG. 3.

Figure 7:
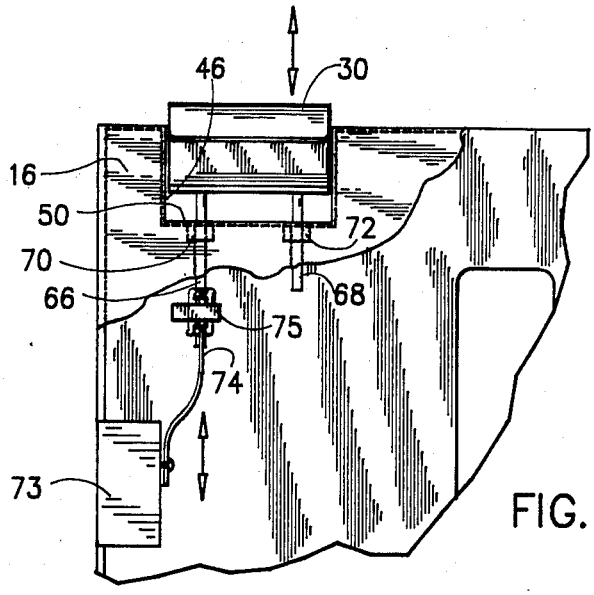
FIG. 7 is an enlarged front elevation view of the handle assembly of FIG. 1 illustrating its handle member in its raised latch mechanism releasing position.

The slide member 38 is slidably supported within the recess in a suitable manner, such as by means of a pair of rods 66 and 68. These rods are slidably received in a pair of bushings 70 and 72 mounted in the lower wall 50 of the recess 32 (FIG. 7). The rods are attached to the slide member by suitable means such a by threaded bores receiving the ends of the rods. The rod 66 forms part of the linkage for connecting the handle member 30 to a door latch mechanism 73.

The door latch mechanism 73 (FIG. 3) may be any conventional type. It my include a latch finger 76 which latches over onto a D-shaped stud 78, for example, attached to the rear of the door frame. The linkage includes a link 74 and coupling 75 connecting rod 66 to the latch mechanism for releasing the latch finger 76. The door handle assembly and the linkage are preferrably designed such that lifting of the handle member 30 about one inch releases the latch.

The handle assembly, in accordance with the invention, requires only sufficient depth to accommodate an edge for grasping and some means, e.g., the linkage for accommodating an actuating movement and connection to the door latch mechanism.

While I have illustrated and described my invention with respect to a specific embodiment, it is to be understood that numerous changes and modifications may be made therein without departing from the spirit and scope of the invention as defined in the appended claims.

I claim:

1. A door handle assembly for an automobile, comprising:

a door having an exterior panel with an upper edge defining the lower boundary of a window opening;

an outward opening box-like recess adjacent said upper edge;

a slide member mounted in said recess for vertical movement in said recess, said slide member having a generally L-shaped cross-section;

a handle member connected to said slide member at an upper end thereof to define a finger slot between said handle member and a lower edge of said slide member, said handle member being shaped to conform to an outer contour of the exterior panel;

said means for mounting said slide member including a pair of elongated rods slidably extending through a bottom wall defining a part of the box-like recess; and linkage means for connecting one of said rods to a latch mechanism.

2. A door handle assembly according to claim 1 wherein:

said handle member is hinged to said slide member and pivots from about fifteen to about twenty-five degrees relative to said slide member.

3. A door handle assembly for an automobile, comprising:

a door having an exterior panel with an upper edge defining the lower boundary of a window opening;

an outwardly and upwardly opening box-like recess formed in the exterior panel adjacent the upper edge;

a slide member dimensioned to fit in the recess;

a handle member shaped to fit within the recess and conform to a contour of the exterior panel adjacent the upper edge;

hinge means for connecting the handle member to an upper end of the slide member for pivoting about a substantially horizontal axis away from the slide member to provide a space between the handle member and the slide member for receiving a person's fingers;

means for mounting the slide member for vertical movement in the recess upon grasping of the handle member and lifting thereof; and linkage means for operatively connecting the slide member to a latch mechanism mounted in the door beneath the upper edge for releasing the latch mechanism upon pivoting the handle member away from the slide member and continued lifting of the handle member to lift the slide member.

4. A door handle assembly according to claim 3 wherein said handle member pivots from about fifteen degrees to about twenty-five degrees relative to said slide member.

5. A door handle assembly according to claim 3 and further comprising spring means for biasing said handle member toward a flush position in which it is aligned with the contour of the exterior panel.

6. A door handle assembly according to claim 5 wherein the spring means includes a V-shaped spring compressed between the handle member and the slide member.

7. A door handle assembly according to claim 3 wherein the means for mounting the slide member includes a pair of elongated rods extending through a bottom wall of the box-like recess.

8. A door handle assembly according to claim 3 wherein the linkage means is configured such that lifting of the handle member approximately one inch releases the latch.

9. A door handle assembly according to claim 7 wherein the mounting means further includes a pair of bushings mounted in the bottom wall for each slideably receiving one of the rods.

10. A door handle assembly for an automobile, comprising:

a door having an exterior panel with an upper edge defining the lower boundary of a window opening;

an outwardly and upwardly opening box-like recess formed in the exterior panel adjacent the upper edge;

an L-shaped slide member dimensioned to reciprocate vertically within the recess and having a vertical leg and a horizontal leg;

means for mounting the slide member for vertical reciprocation in the recess including at least one rod connected to the horizontal leg and slideably extending through a bottom wall of the recess;

a handle member shaped to fit within the recess and conform to a contour of the exterior panel adjacent the upper edge;

hinge means for pivotally connecting the handle member to an upper edge of the vertical leg of the slide member for rotation about a horizontal axis from a flush position in which the handle member is aligned with the contour of the exterior panel, through an angle of between about fifteen degrees to about twenty-five degrees relative to the slide member to an extended position when a person grasps the handle member and lifts upwardly, the hinge means being configured such that a lower edge of the handle member pivots outwardly from the slide member to define a space for accommodating the person's fingers;

spring means normally biasing the handle member to its flush position; and linkage means for operatively connecting the rod to a latch mechanism mounted in the door beneath the upper edge so that when a person grasps the handle member, rotates the handle member and lifts the slide member, the latch mechanism will be released.

* * * * *